US010775118B1

(12) United States Patent
Simek

(10) Patent No.: US 10,775,118 B1
(45) Date of Patent: Sep. 15, 2020

(54) FIREARM

(71) Applicant: CESKA ZBROJOVKA A.S., Uhersky Brod (CZ)

(72) Inventor: Vladimir Simek, Uhersky Brod (CZ)

(73) Assignee: Ceska Zbrojovka A.S., Uhersky Brod (CZ)

( * ) Notice: Subject to any disclaimer, the term of this patent is extended or adjusted under 35 U.S.C. 154(b) by 209 days.

(21) Appl. No.: 16/087,062

(22) PCT Filed: Apr. 20, 2017

(86) PCT No.: PCT/CZ2017/000027
§ 371 (c)(1),
(2) Date: Sep. 20, 2018

(87) PCT Pub. No.: WO2017/186195
PCT Pub. Date: Nov. 2, 2017

(30) Foreign Application Priority Data

Apr. 25, 2016 (CZ) ..... 2016-237

(51) Int. Cl.
*F41A 3/72* (2006.01)

(52) U.S. Cl.
CPC ..... *F41A 3/72* (2013.01)

(58) Field of Classification Search
CPC ..... F41A 3/72
(Continued)

(56) References Cited

U.S. PATENT DOCUMENTS 4,052,926 A * 10/1977 Tollinger ..... F41A 3/72 89/1.4
8,307,747 B2 * 11/2012 Fitzpatrick ..... F41A 9/38 89/1.4
(Continued)

FOREIGN PATENT DOCUMENTS

GB 413071 A 7/1934
GB 511870 A 8/1939

OTHER PUBLICATIONS

International Search Report from Corresponding International Application No. PCT/CZ2017/000027 dated Jul. 4, 2017 (2 pages).
Written Opinion of the International Searching Authority from Corresponding International Application No. PCT/CZ2017/000027 dated Jul. 4, 2017 (5 pages).
(Continued)

*Primary Examiner* — Samir Abdosh
(74) *Attorney, Agent, or Firm* — Hovey Williams LLP

(57) ABSTRACT

The firearm comprises a firearm housing (1) connected to the barrel assembly (2), a firearm breech (3) mounted in the housing (1) and connected to a spring for forcing the breech (3) to its initial shooting position, a tensioning lever (11), a tensioning lever (11) carrier (4) that is connected to the tensioning lever (11) and arranged for common linear movement in the axial direction of the firearm with the tensioning lever (11) in and against the shooting direction. The tensioning lever (11) contains the first latch (6) and lever part (7) wherein the first latch (6) is arranged for controlled movement by means of manual control of the lever part (7) from the first position—shooting position, wherein the first latch (6) is engaged with the barrel assembly (2), fixing the tensioning lever (11) to the barrel assembly (2), to the second position, wherein this engagement is disconnected and the tensioning lever (11) can move in the said axial direction against the shooting direction. The carrier (4) comprises the second latch (5) arranged in such a way that when the first latch (6) is in the said first position, the second latch (5) is out of engagement with the breech (3), so the breech (3), during its movement against the shooting direction caused by the shot, is not connected to the carrier (4), and when the tensioning lever (11) is outside the shooting position and touches the breech (3) at the same time, the second latch (5) is in engagement with the breech (3) and the tensioning lever (11) is thus fixed to the breech (3). The
(Continued)

carrier (4) is further arranged for controlled movement in the said axial direction by means of manual control of the lever part (7).

5 Claims, 4 Drawing Sheets

(58) Field of Classification Search
USPC ..... 89/1.4
See application file for complete search history.

(56) References Cited

U.S. PATENT DOCUMENTS

| | | | | |
|---|---|---|---|---|
| 8,539,871 | B1 * | 9/2013 | Burt | F41A 9/38 89/1.4 |
| 2011/0226120 | A1 * | 9/2011 | Fitzpatrick | F41A 19/47 89/1.4 |
| 2012/0042769 | A1 * | 2/2012 | Makayama | F41A 9/38 89/1.4 |
| 2013/0228065 | A1 * | 9/2013 | Fitzpatrick | F41A 3/72 89/1.4 |

OTHER PUBLICATIONS

International Preliminary Report on Patentability from Corresponding International Application No. PCT/2017/000027 completed Mar. 15, 2018 (5 pages).

* cited by examiner

FIREARM

RELATED APPLICATIONS

This application is the National Stage of International Patent Application No. PCT/CZ2017/000027, filed Apr. 20, 2017, which is hereby incorporated herein by reference in its entirety, and which claims priority to Czech Patent Application No. CZ 2016-237, filed Apr. 25, 2016, which is also incorporated herein by reference in its entirety.

FIELD OF THE INVENTION

The invention relates to a firearm, in particular to a firearm with a tensioning lever with an unchanged position during the movement of the breech caused by the shot. The firearm comprises a tensioning lever that is independent of the movement of the breech during shooting in the said sense. The tensioning lever is used to manually pull the breech to the rear position; after its releasing the firearm is loaded. Further, it makes it possible, in case of incomplete closing of the breech, to move it to the initial front position before firing. The tensioning lever can be positioned at the right or left side of the firearm housing.

BACKGROUND OF THE INVENTION

An example of a design known from the prior art is the design contained in the document GB413071A. This document discloses a tensioning lever assembly that comprises a tilting tensioning lever connected to the breech. The purpose of the tilting design of the tensioning lever is that the tensioning lever should not disturb the shooter during shooting.

In the prior art designs, several common approaches to the design of the tilting lever arrangement can be generally distinguished.

1. Tensioning Lever Fixed to the Breech

This is the most frequently used design, which is mainly advantageous for its simplicity and easy interchangeability of the side of the firearm where the lever is mounted (in the case of the position of the tensioning lever at the right or left side of the firearm in the shooting direction). A disadvantage of this design is that the lever moves during shooting while this movement may disturb the shooter or there is a potential risk of injury of the operator if the firearm is gripped in an unsuitable manner.

2. The Tensioning Lever is Independent of the Breech Movement During Shooting.

From the operation point of view, this design is more advantageous than that with the tensioning lever being fixed to the breech. The tensioning lever is fixed to the firearm housing during shooting and does not disturb the operator. On current firearms, the tensioning lever is installed at the left or right side of the firearm housing, or in the rear part of the housing over the shoulder support of the firearm.

The disadvantages of the said designs are:

- necessity to have a special mechanism to push the breech to its front position in case of "incomplete closing" (during loading of the firearm or after a shot the breech will not move to the initial front position and before the next shot, the operator must move the breech to this position manually),
- the need to fix the tensioning lever in the front position during firing (by connecting it to the firearm housing or a spring acting in the firing direction), and

- complexity of the mechanism of the tensioning lever in case of variable mounting of the tensioning lever at the right or left side of the firearm housing in the firing direction—the mechanism has up to twice the number of parts to ensure its operability from both the sides.

SUMMARY OF THE INVENTION

The disadvantages of the prior art are eliminated by a firearm in accordance with the invention, comprising a firearm housing connected to the barrel assembly, a firearm breech mounted in the housing and connected to a spring for forcing the breech to its initial shooting position, a tensioning lever as well as a tensioning lever carrier that is connected to the tensioning lever and arranged for common linear movement in the axial direction of the firearm with the tensioning lever in and against the shooting direction, wherein the tensioning lever contains the first latch and lever part, wherein the first latch is arranged for controlled movement by means of manual control of the lever part from the first position—shooting position, wherein the first latch is engaged with the barrel assembly, fixing the tensioning lever to the barrel assembly, to the second position, wherein this engagement is disconnected and the tensioning lever can move in the said axial direction against the shooting direction, and the carrier comprises the second latch arranged in such a way that when the first latch is in the said first position, the second latch is out of engagement with the breech, so the breech, during its movement against the shooting direction caused by the shot, is not connected to the carrier, and when the tensioning lever is outside the shooting position and touches the breech at the same time, the second latch is in engagement with the breech and the tensioning lever is thus fixed to the breech, the carrier being further arranged for controlled movement in the said axial direction by means of manual control of the lever part.

In one of preferred embodiments, the tensioning lever comprises a spring arranged to force the first latch into engagement with the barrel assembly and the lever part arranged in such a way that manual exertion of a force against the shooting direction on the lever part will set the first latch in motion from the said first position to the said second position against the spring force.

In one of preferred embodiments, the tensioning lever is inserted in a carrier, and can be inserted into the carrier optionally in such a way that the lever part can be mounted at the right or left side of the firearm.

The firearm is preferably arranged in such a way that the tensioning lever and carrier are removable from the housing without the use of any tools.

The tensioning lever preferably comprises a grip that the lever part is fitted with.

The new design of the loading mechanism describes the option that enables positioning of the tensioning lever at the right or left side of the firearm housing. To minimize the number of parts in the loading mechanism, it is not just the tensioning lever as such but an assembly of several parts that changes its side. The assembly contains both the tensioning lever and the latch that ensures fixing of the loading mechanism to the firearm housing during shooting. The carrier of the tensioning lever remains in the firearm housing, wherein the tensioning lever assembly can be inserted into the carrier from the left or right side.

In case of a fault of the firearm, when the firearm breech needs to be moved manually to the front position, the carrier of the tensioning lever can contain a latch that will ensure connection of the carrier of the tensioning lever and the firearm breech. A precondition for this design is that in the front position of the breech, the carrier of the tensioning lever and the breech must get disconnected again to ensure independent movement of the breech and tensioning lever during shooting.

BRIEF DESCRIPTION OF THE DRAWINGS

The invention will be further clarified with the use of its embodiment example with reference to attached drawings, where.

DETAILED DESCRIPTION OF EMBODIMENTS

Figure 1:
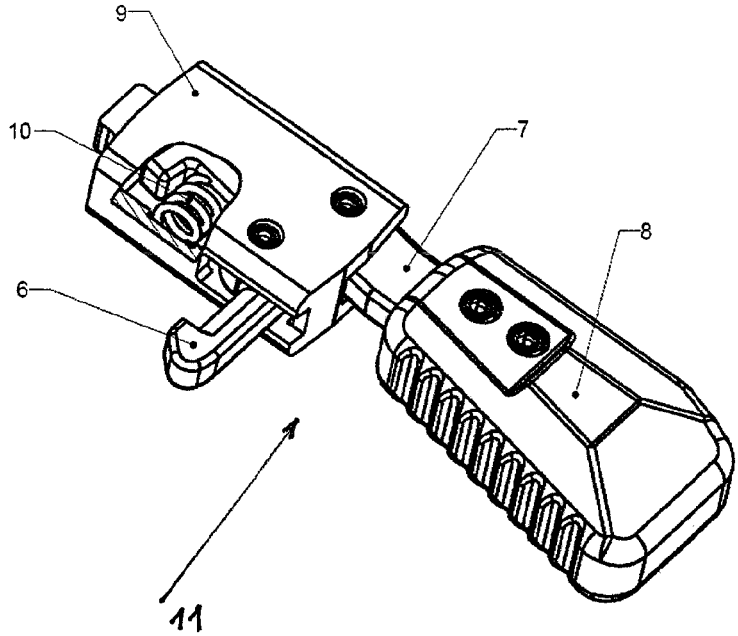
FIG. 1 shows the tensioning lever of a firearm according to the invention.

FIG. 1 shows the tensioning lever 11 of a firearm according to the invention. As shown in FIG. 1, the tensioning lever 11 comprises a base 9, a lever part 7, the first latch 6 and a spring 10. The spring 10 acts upon the first latch 6, which fixes the tensioning lever 11 to the barrel assembly 2 during shooting (see FIG. 2). To improve handling, a grip 8 is mounted on the lever part 7.

Figure 2:
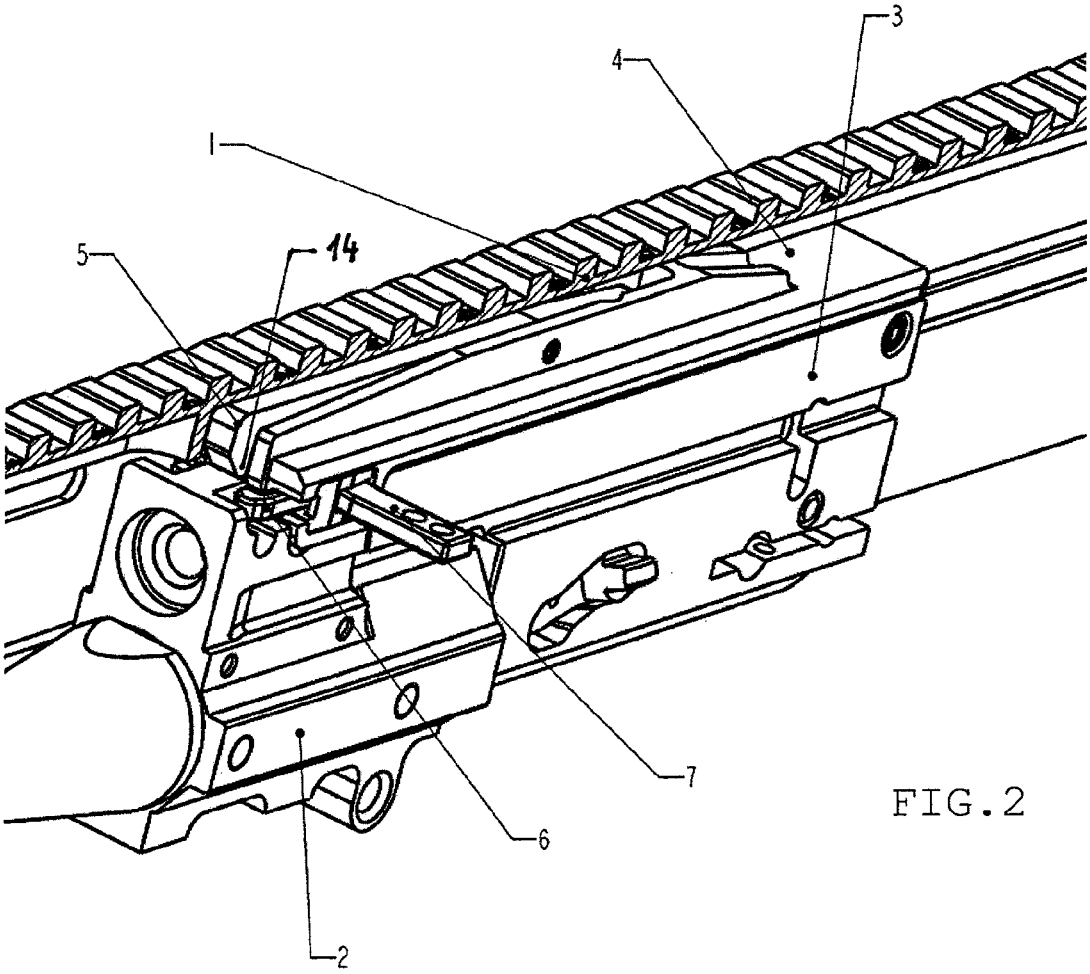
FIG. 2 shows a perspective view of the embodiment example of the firearm according to the invention with the firearm breech in the front position.

As shown in FIG. 2, before a shot goes off, the breech 3 is in the initial front position—position before shooting and the tensioning lever 11 is, by means of the first latch 6, which is engaged with the barrel assembly 2, fixed to the barrel assembly 2. The barrel assembly 2 is fixed to the housing 1.

Figure 3:
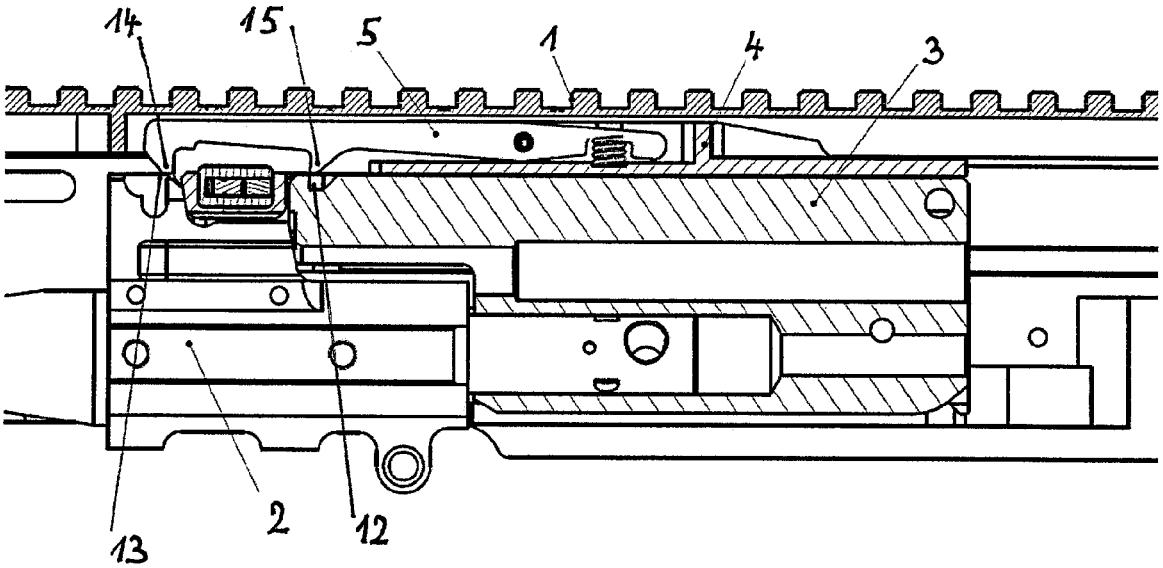
FIG. 3 shows the firearm of FIG. 2 in a partial longitudinal cross-section.

Similarly to FIG. 2, FIG. 3 also shows the firearm in the position before shooting, but in a cross-section. The firearm comprises a housing 1 connected to the barrel assembly 2 and a breech 3 that is mounted in the housing 1 and a return spring (not shown) holds it in the initial position before shooting where it is in contact with the barrel assembly 2. The return spring is pretensioned in such a way to push the breech 3 forwards (i.e. in the shooting direction) to the position before shooting. Over the breech 3, the sliding carrier 4 of the tensioning lever 11 is positioned, the carrier being connected to the tensioning lever 11 in such a way that the tensioning lever 11 is inserted in the carrier 4, so the carrier 4 and the tensioning lever 11 always linearly move together forwards (in the shooting direction) or backwards (against the shooting direction). Thus, the carrier 4 is arranged as linearly moving in and against the shooting direction, wherein in FIG. 3 it is shown in its front position, wherein the second latch 5, which is fixed to the body of the carrier 4 in a rotary way, is in a lifted position because it is lifted by the barrel assembly 2 at its front tooth 14 as the front tooth 14 sits on the barrel assembly 2 in the contact place 13. Due to this lifting, the rear tooth 15 of the second latch 5 is also out of engagement with the breech 3, so after the shot, the breech 3 can move, without engagement with the second latch 5, backwards, i.e. against the shooting direction against the action of the above mentioned return spring acting upon the breech 3. In the initial front position—in the shooting position (position before the shot), the carrier 4 is fixed in its front position by means of the first latch 6 engaged with the barrel assembly 2, fixing the position of the tensioning lever 11 and consequently the carrier 4 connected to the tensioning lever 11.

During the shot, when the breech 3 moves against the shooting direction, the tensioning lever 11 is fixed in the front position by tooth on the first latch 6. The second latch 5, as described above, is in the lifted position due to a contact with the barrel assembly 2 in the contact place 13, and therefore it is deflected in such a way that it does not get in contact with the breech 3, which can move against the shooting direction after the shot thanks to this.

Figure 5:
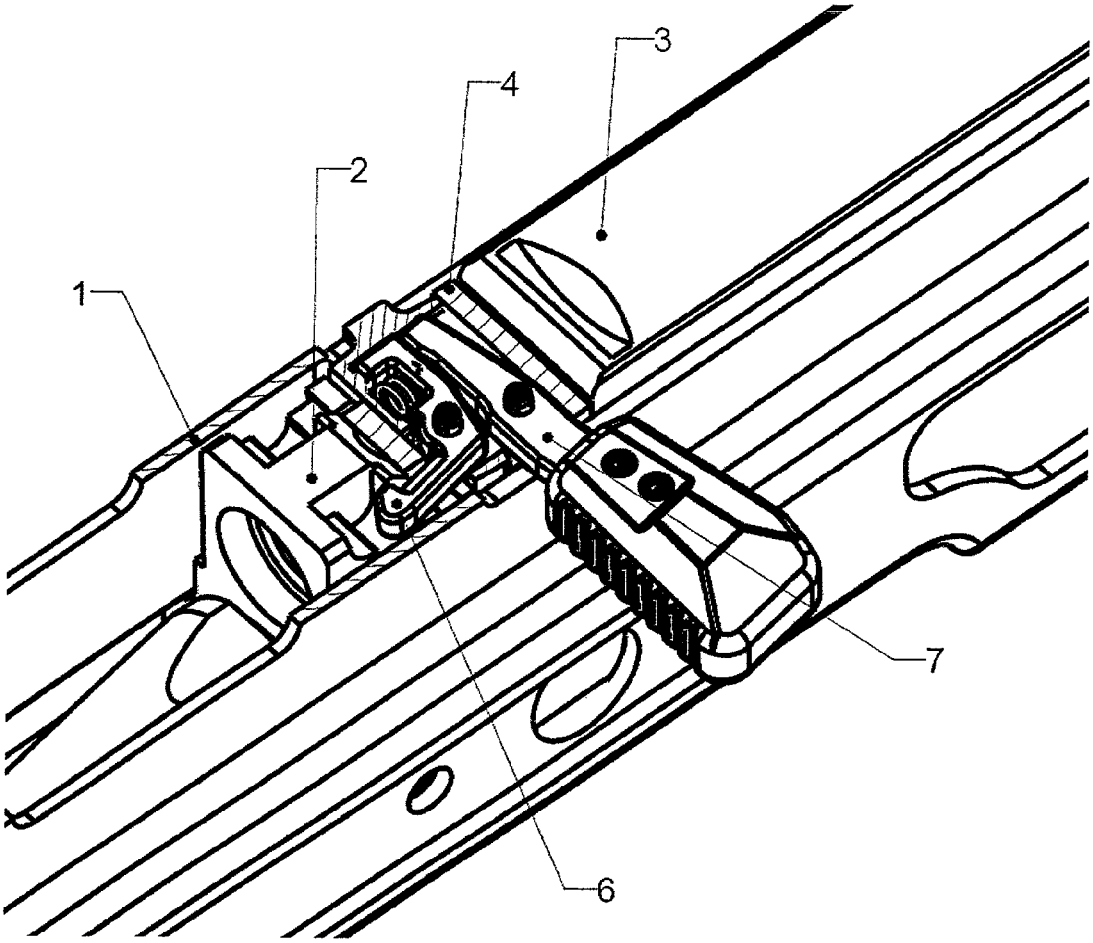
FIG. 5 shows the mechanism of cooperation of the tensioning lever with the barrel assembly in the firearm of FIGS. 2 to 4.

The breech 3 is moved manually to the rear position when force is exerted on the lever part 7 against the shooting direction. As one can infer e.g. from FIG. 5, the first latch 6 is first deflected by tilting of the tensioning lever 7, which will get the latch out of engagement with the barrel assembly 2, so further pushing of the tensioning lever 7 against the shooting direction will cause removal of the tensioning lever 11 together with the guide 4, which is connected to the tensioning lever 11, so it moves together with the tensioning lever 11. The removal of the tensioning lever 11 from the front position before the shot (from the shooting position) will result in the front tooth 14 of the second latch 5 being no longer lifted by the barrel assembly 2 in the contact place 13, so the second latch 5 will descend from the lifted position and its rear tooth 15 will fit into the recess 12, getting in engagement with the breech 3. This way, a connection will be established between the carrier 4 and the breech 3. To move the breech 3 to the front position again, it is sufficient to release the lever part 7—by the action of the return spring, which pushes the breech 3 forwards, the breech 3 with the carrier 4 and the tensioning lever 11 will return to the initial front position before the shot.

Figure 4:
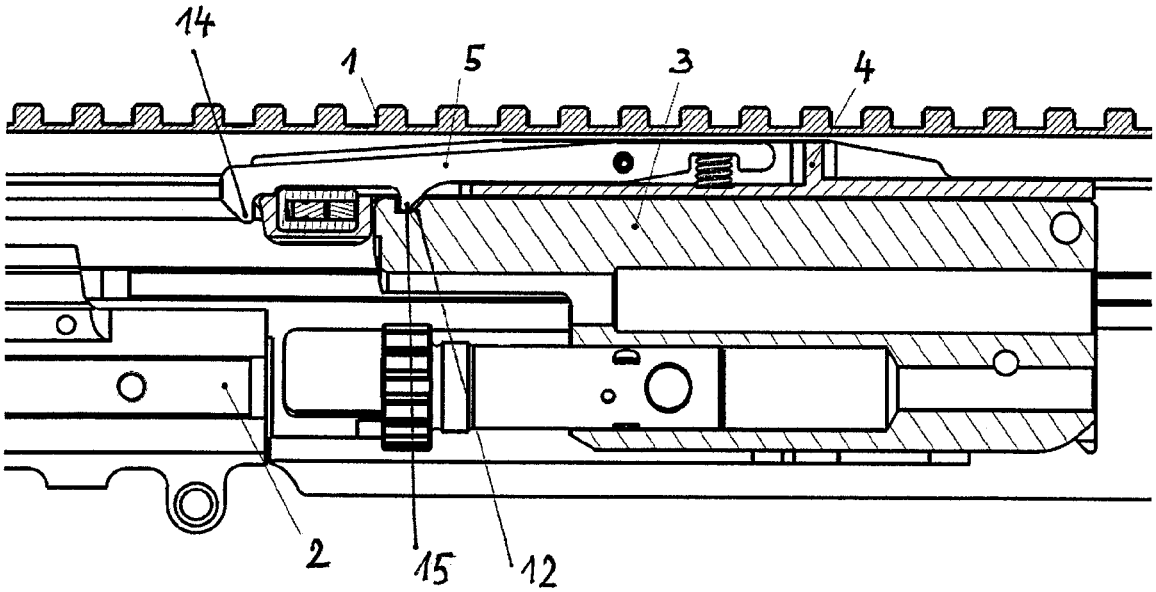
FIG. 4 shows the firearm of FIG. 3 with the breech removed outside the initial front position.

In case of "incomplete closing", i.e. condition when the breech 3 does not completely move to the front position during loading of the firearm or after the shot and the operator must move the breech 3 to the front position manually before_the subsequent shot, the tensioning lever 11 with the carrier 4 must first be put in contact with the breech 3. This will ensure their mutual fixation through the second latch 5, which engages into a recess 12 in the breech 3 with its rear tooth 15 as this condition is shown in FIG. 4. Then, force can be exerted on the lever part 7 in the shooting direction to move the breech 3 to the initial front position before the shot.

Figure 6:
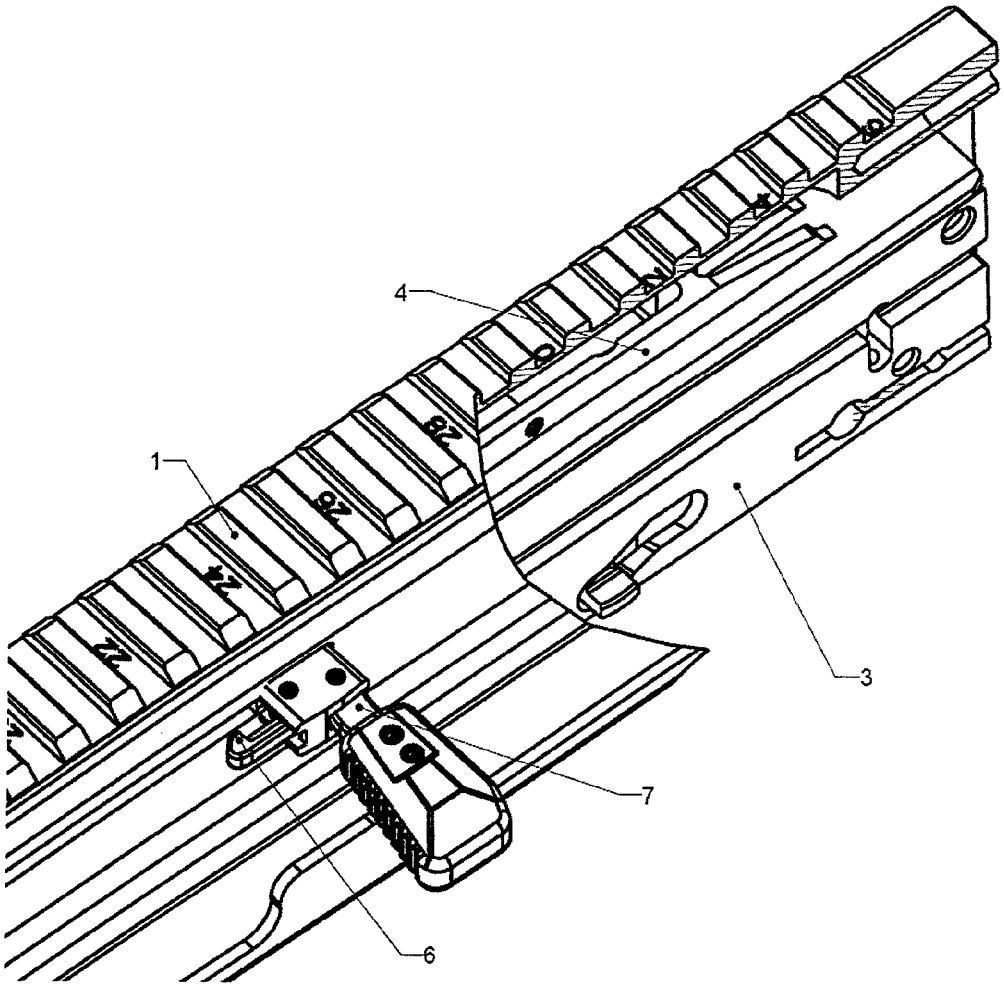
FIG. 6 shows the firearm of FIGS. 2 to 5 with the position of the firearm breech and the carrier of the tensioning lever wherein the right or left mounting side of the tensioning lever assembly can be changed.

The tensioning lever 11 can be optionally mounted at the right or left side of the housing 1 within the basic dismantling. FIG. 6 shows the position of the breech 3 and carrier 4 where the right or left mounting side of the tensioning lever 11 can be changed. The tensioning lever 11 can be removed thanks to the recess in the housing 1.

LIST OF REFERENCE MARKS

1—Housing
2—barrel assembly
3—breech
4—carrier (of the tensioning lever)
5—second latch
6—first latch
7—lever part
8—grip
9—base

10—spring
11—tensioning lever
12—recess
13—contact place
14—front tooth
15—rear tooth

The invention claimed is:

1. A firearm comprising a firearm housing connected to a barrel assembly, a firearm breech mounted in the firearm housing and connected to a spring for forcing the breech to an initial shooting position, and a tensioning lever, wherein the firearm comprises a tensioning lever carrier that is connected to the tensioning lever and arranged for common linear movement in the axial direction of the firearm with the tensioning lever in and against a shooting direction, wherein the tensioning lever contains a first latch and lever part, wherein the first latch is arranged for controlled movement by means of manual control of the lever part from a first position-shooting position, wherein the first latch is engaged with the barrel assembly, fixing the tensioning lever to the barrel assembly, to a second position, wherein this engagement is disconnected and the tensioning lever can move in an axial direction against the shooting direction, and the carrier comprises a second latch arranged in such a way that when the first latch is in the first position, the second latch is out of engagement with the breech, so the breech, during its movement against the shooting direction caused by a shot, is not connected to the carrier, and when the tensioning lever is outside the initial shooting position and touches the breech at the same time, the second latch is in engagement with the breech and the tensioning lever is thus fixed to the breech, the carrier being further arranged for controlled movement in the axial direction by means of manual control of the lever part.

2. The firearm according to claim 1, wherein the tensioning lever comprises a spring arranged to force the first latch into engagement with the barrel assembly and the lever part arranged in such a way that manual exertion of a force against the shooting direction on the lever part will set the first latch in motion from the first position to the second position against the force of the spring.

3. The firearm according to claim 1, wherein the tensioning lever is inserted in the carrier while the tensioning lever can be optionally inserted into the carrier in such a way that the lever part can be positioned at the right or left side of the firearm.

4. The firearm according to claim 1, wherein the firearm is arranged in such a manner that the tensioning lever and the carrier are removable from the housing without the use of any tools.

5. The firearm according to claim 1, wherein the tensioning lever comprises a grip that the lever part is fitted with.

* * * * *